US010407851B2

(12) United States Patent
Montens

(10) Patent No.: US 10,407,851 B2
(45) Date of Patent: Sep. 10, 2019

(54) OVERHEAD GUIDED-TRANSPORT TRACK SPAN, AND VIADUCT FORMED BY SUCH SPANS

(71) Applicant: SYSTRA, Paris (FR)

(72) Inventor: Serge Montens, La Celle St Cloud (FR)

(73) Assignee: SYSTRA, Paris (FR)

( * ) Notice: Subject to any disclaimer, the term of this patent is extended or adjusted under 35 U.S.C. 154(b) by 238 days.

(21) Appl. No.: 15/506,715

(22) PCT Filed: Aug. 20, 2015

(86) PCT No.: PCT/FR2015/052241
§ 371 (c)(1),
(2) Date: Feb. 24, 2017

(87) PCT Pub. No.: WO2016/046461
PCT Pub. Date: Mar. 31, 2016

(65) Prior Publication Data

US 2018/0223487 A1 Aug. 9, 2018

(30) Foreign Application Priority Data

Sep. 22, 2014 (FR) ..... 14 58895

(51) Int. Cl.
*E01D 19/12* (2006.01)
*E01B 2/00* (2006.01)
*E01D 2/00* (2006.01)

(52) U.S. Cl.
CPC ..... *E01D 19/125* (2013.01); *E01B 2/003* (2013.01); *E01D 2/00* (2013.01); *E01D 19/12* (2013.01)

(58) Field of Classification Search
CPC ..... E01B 25/00; E01B 25/08; E01B 25/22; E01B 25/24
See application file for complete search history.

(56) References Cited

U.S. PATENT DOCUMENTS 4,313,383 A * 2/1982 Parazader ..... E01D 19/125 104/118
8,061,494 B2 * 11/2011 Rameau ..... B60M 1/307 104/124

FOREIGN PATENT DOCUMENTS

DE 202009008365 10/2010
FR 2882375 8/2006

* cited by examiner

*Primary Examiner* — Robert J McCarry, Jr.
(74) *Attorney, Agent, or Firm* — Steven M. Greenberg, Esq.; Shutts & Bowen LLP

(57) ABSTRACT

The invention relates to an overhead guided-transport track span having a U-shaped cross section, the two arms of which form lateral walls (4, 5) of said track, and the central region of which, connecting the two arms, forms a load-bearing slab (6) of said track, characterised in that said load-bearing slab (6) comprises at least one groove (10, 11) that is provided in said slab longitudinally along said span and is designed to be able to receive a running support (12, 13) of a guided-transport vehicle intended to travel on said track.

10 Claims, 2 Drawing Sheets

OVERHEAD GUIDED-TRANSPORT TRACK SPAN, AND VIADUCT FORMED BY SUCH SPANS

CROSS-REFERENCE TO RELATED APPLICATIONS

Figure 1:
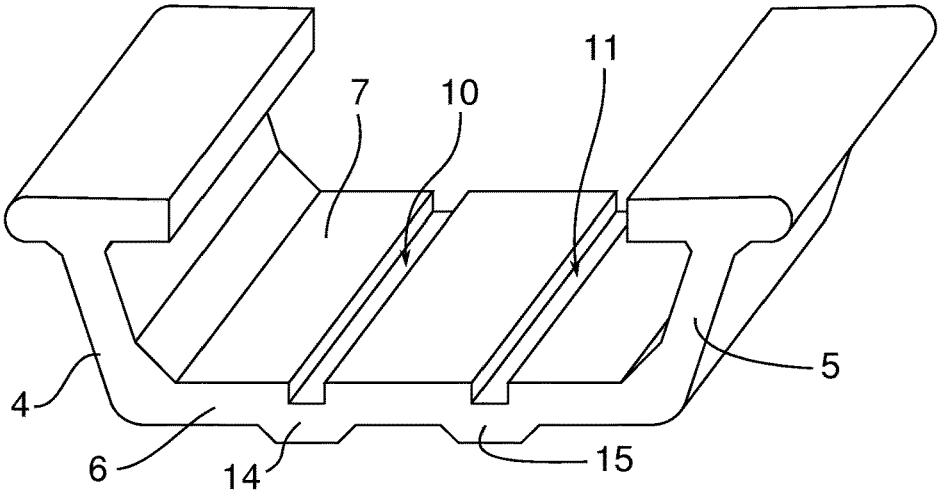

This application is a § 371 national phase entry of International Application No. PCT/FR2015/052241, filed Aug. 20, 2015, which claims priority to French Patent Application No. 1458895, filed Sep. 22, 2014.

1. Technical Field of the Invention

The invention relates to an overhead guided-transport track span, in particular a viaduct having a U-shaped cross section, in particular in the shape of a flared U. The invention also relates to a guided-transport viaduct comprising a plurality of spans according to the invention.

2. Technological Prior Art

Guided public transport lines such as undergrounds and trains, whether tyre-based or rail-based, often comprise works of art, such as viaducts or bridges, which allow rolling stock to pass through regions where it is too difficult or expensive to lay an underground track given the layout of the places.

In the patent FR2882375, the applicant has already developed and described a viaduct span having a U-shaped cross section and comprising a load-bearing slab that supports the track, and at least one runway on which a guided-transport vehicle can travel. In the case of a rail vehicle, the runway is a shoe that is carried by the load-bearing slab and to which the rails intended for guiding the rail vehicle are attached.

In practice, the operations for mounting the rails on the spans are complicated and require rigour and precision.

The applicant has therefore sought to develop an overhead track span, in particular a viaduct span, that makes it possible to simplify the operations for mounting rails on the span. The applicant has also sought to simplify the construction of a viaduct from such spans, to reduce the weight of a span, and to improve the acoustics and the aesthetics of a span and of a viaduct formed from such spans.

3. Aims of the Invention

The invention aims to remedy at least some of the disadvantages of the known solution, in particular with a view to simplifying the operations for mounting rails on the spans of a guided-transport viaduct.

In particular, the invention aims to provide an overhead guided-transport track span having a U-shaped cross section.

The invention also aims to provide, in at least one embodiment, a span that contributes to reducing noise emissions from a vehicle travelling on the portion of track formed by the span.

The invention also aims to provide, in at least one embodiment of the invention, a span that has improved aesthetics compared with the spans of the prior art.

The invention also aims to provide a viaduct formed by a plurality of spans according to the invention.

4. Disclosure of the Invention

In order to achieve this, the invention relates to an overhead guided-transport track span having a U-shaped cross section, the two arms of which form lateral walls of said track and the central region of which, connecting the two arms, forms a load-bearing slab of said track.

A span according to the invention is characterised in that said load-bearing slab comprises at least one groove that is provided longitudinally in said slab along said span and is designed to be able to receive a running support of a guided-transport vehicle intended to travel on said track, and in that the span comprises one longitudinal rib for each groove, which rib extends under said load-bearing slab opposite to said groove and forms longitudinal stiffening means of said load-bearing slab.

A span according to the invention thus comprises at least one groove that is provided directly in the load-bearing slab. The load-bearing slab forms the deck of the span. This groove (or recess) forms a pocket for receiving a running support, such as a rail, of a transport vehicle intended to travel on the span. The invention therefore consists in producing a pocket for receiving a running support of a vehicle, such as a rail, directly in the deck of the span. In other words, according to the invention, the span makes it possible to directly integrate the running supports, such as the rails, in the deck of the span. Thus, according to the invention, the running supports, such as the rails, are provided directly in the grooves and not on the shoes (or stringers) of the prior art that were raised with respect to the load-bearing slab. It is therefore particularly simple to mount the rails using a span according to the invention, the operators only needing to arrange the rails in the grooves and no longer needing to attach said rails to the shoes.

It is likewise possible, using a span according to the invention, to provide the running supports, such as the rails, directly in the workshop before mounting the span on the piles of the viaduct on which it is intended to be used. In other words, using spans according to the invention it is possible to prepare integrated track portions that will then be assembled together on site, which makes the on-site mounting and installation operations easier.

Moreover, since the rails are accommodated directly in the grooves, it is not necessary to provide kerbs on either side of each rail, as is the case in the spans of the prior art. The construction of a span according to the invention is therefore made easier.

Moreover, since the rail is accommodated in the groove, the acoustic signals resulting from interaction between the vehicle wheels and the rails are trapped in the groove, thus limiting the propagation of said signals to the surroundings of the span. The acoustic signals are also blocked more than is the case in the spans of the prior art because the noise source is accommodated in the load-bearing slab, further away from the upper edges of the lateral walls of the span than is the case in a span in which the rail is mounted on a shoe which is, itself, carried by the load-bearing slab. A span according to the invention thus makes it possible to limit the interfering noise caused by transport vehicles travelling on the transport track.

Furthermore, the span according to the invention comprises one longitudinal rib for each groove, which ribs extend under said load-bearing slab opposite to said groove and form longitudinal stiffening means of said load-bearing slab.

These ribs not only stiffen the load-bearing slab, but also provide a span according to the invention with aesthetics that are more visually pleasing than is the case in a span of the prior art, by removing the lower planar surface which was considered harsh in appearance. In particular, arranging ribs under the load-bearing slab forms a relief pattern that is considered more pleasing to the eye than the planar surface of a span of the prior art. In a variant, the lower surface of the load-bearing slab can be provided with lights in order to illuminate the lower portion of the span and to provide additional visual comfort to a span according to the invention.

The stiffening means make it possible to longitudinally stiffen the load-bearing slab, which permits an improved longitudinal distribution of the loads concentrated in the region of the axles of the vehicle intended to travel on the track. This improved load distribution makes it possible to reduce transverse bending moments in the load-bearing slab and thus to reduce the corresponding transverse reinforcement or to reduce the thickness of the constant transverse reinforcement slab.

These stiffening means also compensate for the absence of material resulting from the presence of the grooves provided in the span. A person skilled in the art was strongly deterred from forming grooves in an overhead track span, in particular because this would weaken the grip of the span. The applicant has overcome this technical prejudice by compensating for the loss of material by fitting means for stiffening the span. The combination of the grooves and the stiffening means thus makes it possible to combine requirements that are in principle irreconcilable, specifically an integrated span that makes operations for mounting rails easier, and improved stability and strength of the span.

Advantageously and according to the invention, each groove has dimensions that are matched to and conjugate with the dimensions of said running support that is intended to be accommodated in said groove such that, once it is arranged in said groove, said running support does not extend beyond the upper surface of said load-bearing slab.

According to this advantageous variant, once accommodated in the groove, the running support, such as a rail, does not extend beyond the upper surface of the load-bearing slab. The upper surface of the slab is substantially at the same level as the rail. It is therefore possible for a tyre-based vehicle, such as an emergency vehicle or a maintenance vehicle, to travel on the track. The track thus produced also makes it possible to easily evacuate passengers from a transport vehicle that breaks down on the track thus formed.

Furthermore, once the running support, such as a rail, is accommodated in the groove, the distance separating the upper portion of the support from the underside of the deck (i.e. the underside of the load-bearing slab) is reduced compared with a conventional viaduct span of a corresponding height, substantially to the height of the stringers. A viaduct comprising spans according to the invention thus has a lesser visual impact than a viaduct comprising conventional spans.

Advantageously, each longitudinal rib is formed by two longitudinal beams that are arranged on either side of each groove.

Advantageously, said stiffening means comprise a trapezoidal caisson provided under the load-bearing slab.

This trapezoidal caisson makes it possible to form a self-supporting structure that can be of a significant length, for example 120 metres.

A track span according to the invention can form a path portion of one or more adjacent guided-transport runways. The number of adjacent runways formed by one track span according to the invention depends on the number of grooves formed in the load-bearing slab and on the type of vehicle travelling on the span. A vehicle generally needs one or two running supports, depending on the type of said vehicle. Most guided-transport vehicles have parallel two-wheel axles and therefore need two running supports provided in two parallel grooves.

Advantageously, one span according to the invention comprises at least two parallel grooves that are provided longitudinally along said span so as to be able to receive one running support each, said grooves being mutually spaced by a distance that corresponds to the distance separating the wheels of a same axle of a guided-transport vehicle intended to travel on the track.

According to this variant, each span comprises at least two grooves, each groove being designed to receive one running support of a guided-transport vehicle, such as a rail. The grooves are mutually spaced by a predetermined distance that corresponds to the distance separating two wheels of a same axle of rolling stock intended to travel on the span.

A span according to this variant thus advantageously makes it possible to form a portion of a track (or runway) for a single vehicle.

According to a variant, the span comprises four parallel grooves that are provided longitudinally in pairs along said span so as to be able to each receive one running support and so as to be able to form, together, a path portion of at least two adjacent tracks.

In order to achieve this, the grooves are mutually spaced in pairs by a distance that corresponds to the distance separating the wheels of a same axle of a guided-transport vehicle intended to travel on each track formed.

A span according to this variant thus advantageously makes it possible to form a portion having two adjacent tracks (or runways).

Advantageously and according to the invention, each running support is selected from the group comprising a railway rail for a wheeled rail vehicle, a central guide rail for a tyre-based vehicle, and a lateral guide rail for a tyre-based vehicle.

A span according to this variant permits the travel of a rail vehicle, or a tyre-based vehicle guided by a central guide rail, or a tyre-based vehicle guided by at least one lateral guide rail.

Advantageously and according to the invention, each running support is a metal profile.

Advantageously, a span according to the invention is formed in one piece.

The invention also relates to a guided-transport viaduct comprising a plurality of spans according to the invention. Preferably, the viaduct comprises a plurality of successive spans supported by piles. The construction of a viaduct according to the invention from spans according to the invention is made easier by the operations for mounting rails in the grooves of the spans, which operations can be carried out either directly at the workshop or on-site without any specific difficulties on account of the absence of specific operations for mounting rails on shoes and the absence of the need to construct separation kerbs on either side of each rail.

The invention also relates to a span and to a viaduct that are characterised in combination by all or some of the features mentioned above or in the following.

5. List of Figures

Figure 2:
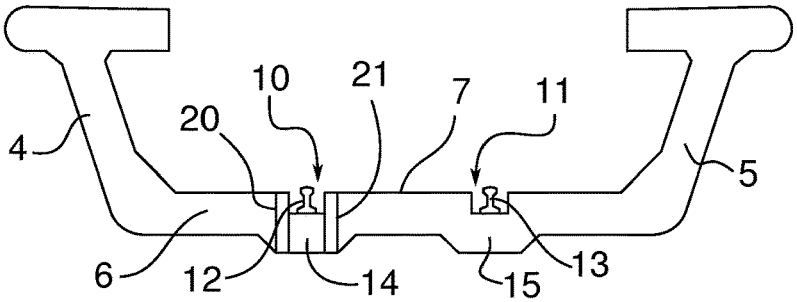
Figure 3:
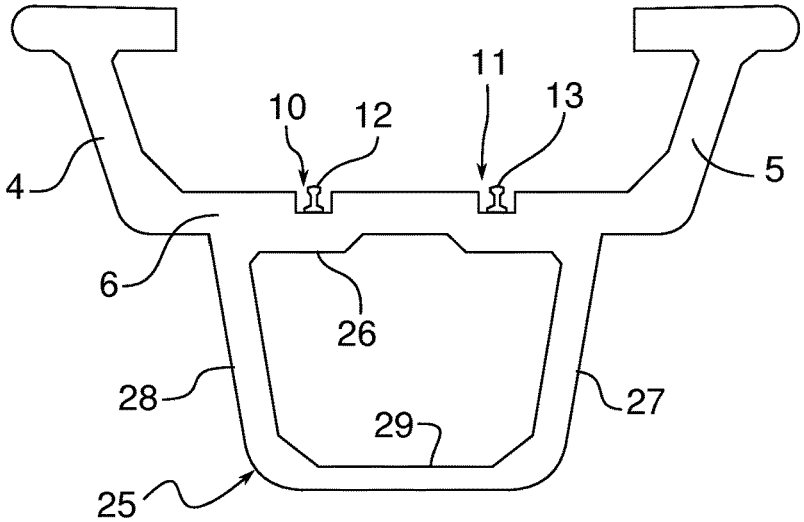
Figure 4:
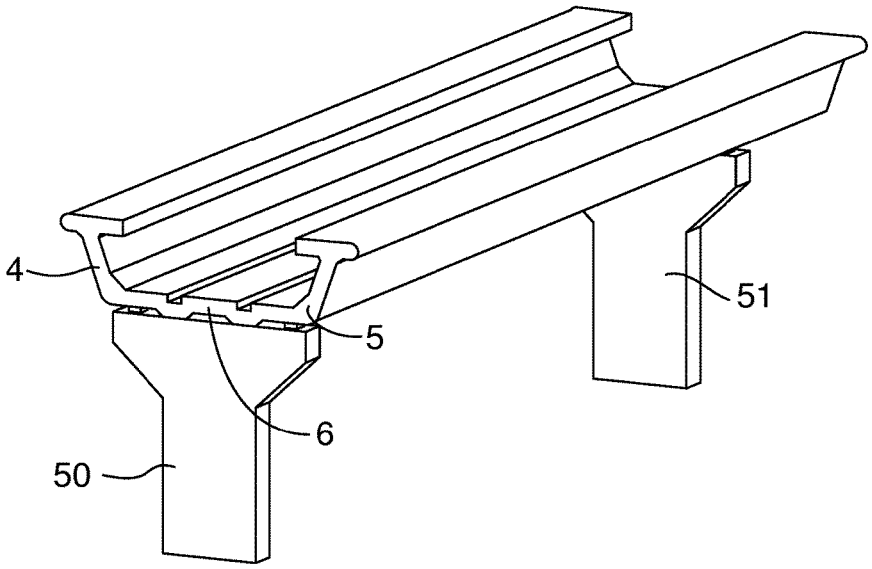
Figure 5:
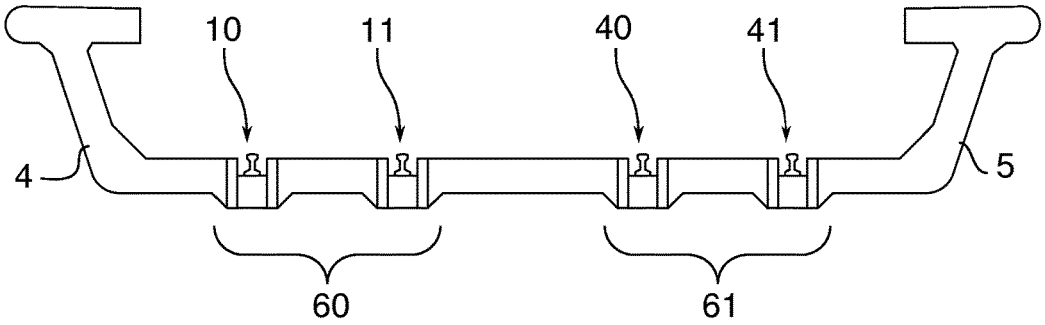

Other aims, features and advantages of the invention will become clear from reading the following description, given purely by way of non-limiting example and with reference to the accompanying drawings, in which:

FIG. 1 is a schematic perspective view of a span according to an embodiment of the invention, FIG. 2 is a schematic cross section of the span from FIG. 1 on which rails have been mounted, FIG. 3 is a schematic cross section of a span according to another embodiment of the invention on which rails have been mounted, FIG. 4 is a schematic perspective view of a viaduct according to an embodiment of the invention that is formed by a plurality of spans according to the invention, FIG. 5 is a schematic cross section of a span according to another embodiment of the invention.

6. Detailed Description of an Embodiment of the Invention

In the drawings, scale and proportion is not adhered to for reasons of illustration and clarity. Throughout the following detailed description, which is given with reference to the drawings, unless otherwise indicated each element of a span according to the invention is described as it is arranged when the span is mounted horizontally, for example on a viaduct pile (not shown in the drawings).

According to the embodiment in the drawings, the guided-transport track span has a flared U-shaped cross section, the two arms of which form lateral walls 4, 5 that are slightly inclined away from one another relative to the vertical, and the central horizontal region of which, connecting the two arms, forms the deck (or load-bearing slab 6) of the track.

The load-bearing slab 6 further comprises two parallel grooves 10, 11 that are provided longitudinally along the span. Each groove has a shape and dimensions that are matched to and conjugate with the shape and the dimensions of a rail, forming a running support for a vehicle that is intended to travel on the track formed by the span. According to the embodiment in the drawings, the grooves have a rectangular cross section that is conjugate with the overall size of a railway rail.

According to the embodiment in the drawings, the grooves 10, 11 are designed to receive rails 12, 13 that are formed by metal profiles and are intended to permit the travel of a railway network train or underground. According to another embodiment, the grooves can receive guide rails or runways of a tyre-based underground.

According to the embodiment in the drawings, the grooves 10, 11 are designed such that, once the rails 12, 13 are accommodated in the grooves they do not extend beyond the upper surface 7 of the load-bearing slab 6. In order to achieve this, the depth of each groove is at least equal to the height of a railway rail. According to an advantageous embodiment and in the case of a groove having a rectangular cross section, the width and the height of each groove are selected so as to be are slightly larger than the nominal values in order to take into account the civil engineering manufacturing tolerances.

The distance separating the grooves 10, 11 is selected so as to be equal to the distance separating the two wheels on an axle of a vehicle intended to travel on the track formed by spans according to the invention.

According to the embodiment in FIGS. 1 and 2, the span further comprises longitudinal ribs 14, 15 that are arranged under the load-bearing slab 6 and form longitudinal stiffening means of the load-bearing slab 6. These longitudinal ribs 14, 15 compensate for the absence of material resulting from the presence of the longitudinal grooves 10, 11 provided in the load-bearing slab 6.

Only the rib 14 is described in detail in the following, given that the rib 15 is identical.

The longitudinal rib 14 is formed for example by two continuous longitudinal reinforced concrete beams 20, 21 that are arranged on either side of the rail 12 once said rail is accommodated in the groove 10 opposite the rib 14.

According to another embodiment of the invention shown in FIG. 3, the span comprises a trapezoidal caisson 25 that is provided under the load-bearing slab 6. This caisson 25 forms the stiffening means for the load-bearing slab 6. This trapezoidal caisson 25 has an upper wall 26 in common with the load-bearing slab 6, a lower wall 29 that is parallel to the upper wall 26, and two lateral walls 27, 28 that interconnect the upper 26 and lower 29 walls to each other. The distance separating the two lateral walls 27, 28 is less than or equal to the distance separating the two lateral walls 4, 5 of the span. A span according to this variant makes it possible to form works of a significant length, for example 120 metres. This thus makes it possible to increase the distance separating two piles of a viaduct formed by a plurality of spans according to this variant, and thus to reduce the number of piles required and the number of spans required to form a viaduct.

According to an advantageous embodiment of the invention, the span is formed in one piece from concrete.

According to other embodiments, the span may be formed by a plurality of pieces of concrete that are assembled together using suitable assembly means.

FIG. 4 shows a viaduct according to an embodiment of the invention that is formed by spans according to the embodiment in FIGS. 1 and 2. The viaduct comprises two piers 50, 51 that are anchored in the ground and on which a span according to the invention rests.

According to another embodiment of the invention, and as shown in FIG. 5, the span comprises four parallel grooves 10, 11, 40, 41 that are provided longitudinally in pairs along the span. Furthermore, a running support rail is arranged in each groove.

The span according to the embodiment in FIG. 5 forms two adjacent running tracks 60, 61 for railway vehicles. A span according to this embodiment thus forms the path portions of two adjacent tracks.

Of course, according to other embodiments, a span according to the invention could comprise more grooves in order to form more parallel transport track portions.

The invention claimed is:

1. An overhead guided-transport track span having a U-shaped cross section, two arms forming lateral walls of said span, and a central region connecting the two arms, and forming a load-bearing slab of at least one track, said load-bearing slab comprising at least one groove that is provided in said slab longitudinally along said span and is adapted to receive a running support of a guided-transport vehicle intended to travel on said span, and in that said span comprises one longitudinal rib for each groove, which rib extends under said load-bearing slab opposite to said groove and forms longitudinal stiffening means of said load-bearing slab.

2. The span according to claim 1, wherein each groove has dimensions that are matched to and conjugate with the dimensions of the running support that is intended to be accommodated in said groove such that, once arranged in said groove, said running support does not extend beyond an upper surface of said load-bearing slab.

3. The span according to claim 1 wherein each longitudinal rib is formed by two longitudinal beams that are arranged on either side of said groove.

4. The span according to claim 1, wherein said stiffening means further comprises a trapezoidal caisson provided under the load-bearing slab.

5. The span according to claim 1, wherein the span comprises at least two parallel grooves that are provided longitudinally along said span so as to be able to each receive one running support.

6. The span according to claim 5, wherein the span comprises four parallel grooves that are provided longitudinally in pairs along said span so as to be able to each receive one running support and so as to be able to form a path portion of at least two adjacent tracks.

7. The span according to claim 1, wherein each running support is a rail selected from the group consisting of a railway rail for a wheeled rail vehicle, a central guide rail for a tire-based vehicle, and a lateral guide rail for a tire-based vehicle.

8. The span according to claim 7, wherein each running support is a metal profile.

9. The span according to claim 1, wherein the span is formed in one piece.

10. A guided-transport viaduct comprising:

a plurality of overhead guided-transport track spans, each of the spans having a U-shaped cross section, two arms forming lateral walls of said span, and a central region connecting the two arms, and forming a load-bearing slab of at least one track, said load-bearing slab comprising at least one groove that is provided in said slab longitudinally along said span and is adapted to receive a running support of a guided-transport vehicle intended to travel on said span, and in that said span comprises one longitudinal rib for each groove, which rib extends under said load-bearing slab opposite to said groove and forms longitudinal stiffening means of said load-bearing slab.

* * * * *